US005829839A

United States Patent [19]

Wilkerson et al.

[11] Patent Number: 5,829,839

[45] Date of Patent: Nov. 3, 1998

[54] HEIGHT-ADJUSTABLE CHAIR ARM ASSEMBLY HAVING GEAR-TYPE ADJUSTING MECHANISM

[75] Inventors: Larry A. Wilkerson, Kent City; Joel Robert Dral, Jenison, both of Mich.

[73] Assignee: Haworth, Inc., Holland, Mich.

[21] Appl. No.: 731,712

[22] Filed: Oct. 17, 1996

[51] Int. Cl.[6] ..... A47C 7/54

[52] U.S. Cl. ..... 297/411.36; 248/118.3; 248/297.51

[58] Field of Search ..... 297/411.36, 410, 297/353, 344.18; 248/292.12, 297.51, 295.11, 118.3; 108/146

[56] References Cited

U.S. PATENT DOCUMENTS

| | | | |
|---|---|---|---|
| 208,823 | 10/1878 | Jennings | 108/146 X |
| 232,790 | 9/1880 | Wernert | 108/146 |
| 504,683 | 9/1893 | Peartree | 108/146 |
| 2,641,309 | 6/1953 | Bostrom et al. | 248/566 |
| 3,194,187 | 7/1965 | Linder et al. | 297/344.18 X |
| 3,856,252 | 12/1974 | Regis | 297/344.18 X |
| 4,632,458 | 12/1986 | Brown et al. | 297/353 |
| 4,830,434 | 5/1989 | Ishida et al. | 297/410 X |
| 5,647,638 | 7/1997 | Ritt et al. | 248/118.3 X |

FOREIGN PATENT DOCUMENTS

| | | | |
|---|---|---|---|
| 1067160 | 1/1954 | France | 108/146 |
| 1227895 | 8/1960 | France | 297/344.18 |
| 17332 | 7/1913 | United Kingdom | 297/344.18 |

*Primary Examiner*—Peter M. Cuomo
*Assistant Examiner*—David E. Allred
*Attorney, Agent, or Firm*—Flynn, Thiel, Boutell & Tanis P.C.

[57] ABSTRACT

A chair having height-adjustable arm assemblies respectively mounted adjacent opposite sides of a seat. Each arm assembly includes a horizontally elongate armrest connected to an upper end of an arm upright. The arm upright includes a vertically oriented support segment which has a guide bore defined therein. The armrest includes a vertically elongate slide tube and a horizontally elongate arm element connected to an upper end of the slide tube. A lower end of the slide tube is movably mounted within the guide bore. A lock arrangement functions to permit the slide tube to be positioned relative to the support segment at any one of a plurality of height positions. The lock arrangement includes a cartridge assembly that has a gear which is rotatably supported and carried by the slide tube. The gear has a plurality of gear teeth which engage with a series of vertically spaced notches defined within the support segment. A lock releasing mechanism functions to displace a lock member between a locking position and a releasing position. The lock releasing mechanism includes an actuator lever and an actuator rod. The actuator lever is supported on the arm element, and the actuator rod extends into the slide tube and mounts the lock member on the lower end thereof. The lock member has locking teeth which engage the gear when the lock member is positioned in the locking position.

18 Claims, 7 Drawing Sheets

HEIGHT-ADJUSTABLE CHAIR ARM ASSEMBLY HAVING GEAR-TYPE ADJUSTING MECHANISM

FIELD OF THE INVENTION

The invention relates to chairs with adjustable arms and, more particularly, to an armrest which can be conveniently vertically adjusted with respect to the chair seat.

BACKGROUND OF THE INVENTION

Chairs designed for use particularly in office environments and the like are being increasingly provided with adjustment features so as to improve the ergonomics of the chair, particularly in those situations where the chair is used for long periods of time, such as when an occupant is working at a computer terminal, to provide improved comfort and healthful support of the occupant's body. One of the areas which has been addressed to improve such comfort relates to the chair arms, and some known chairs have provided arms having position adjustability, particularly with respect to the ability to vary the armrest height relative to the seat. The known chairs which possess height-adjustable chair arms typically employ vertically telescopic supports and a cooperating releasable latch arrangement for permitting height adjustment. Most known arrangements, however, have disadvantages, either from a manufacturing or structural viewpoint, or from an operational viewpoint. For example, many of the structures are undesirably complex, and/or do not provide for approximately continuous height adjustment (in contrast to discrete height adjustment at a small number of widely spaced-apart discrete positions) and/or have a less secure locking arrangement that may allow disengagement of the locking parts which may cause the accidental lowering of the armrest relative to the chair seat and/or the overall support arrangement and cooperating latch mechanism is such as to make release of the latch and adjustment of arm height difficult or inconvenient, particularly to an occupant seated in the chair.

Examples of known height-adjustable chair arms are shown in the following U.S. Pat. Nos.: 5,439,267, 5,435,626, 5,393,125, 5,393,124, 5,388,892, 5,382,079, 5,368,365, 5,346,284, 5,324,096, 5,318,347 and 5,265,938.

Accordingly, it is an object of this invention to provide a chair having a height-adjustable arm assembly associated therewith, which arm assembly significantly improves upon and overcomes many of the disadvantages as briefly summarized above.

More specifically, the improved height-adjustable chair arm assembly of this invention provides an improved locking mechanism which extends through the armrest and into the arm upright so as to permit easy and efficient unlocking and height adjustment if desired, with the occupant in a seated position being able to easily release and maintain the locking mechanism in a releasing position, and with the occupant having the feel of approximately continuous height adjustment of the arm assembly, while at the same time permitting the occupant to easily raise or lower the arm while seated, and then permit the locking mechanism to re-engage.

Briefly, the present invention comprises a chair having height-adjustable arm assemblies respectively mounted adjacent opposite sides of a seat. Each arm assembly includes a horizontally elongate armrest which is connected to an upper end of an arm upright. The arm upright includes a vertically oriented support segment which has a guide bore defined therein. The armrest includes a vertically elongate slide tube and a horizontally elongate arm element. The arm element is connected to an upper end of the slide tube. A lower end of the slide tube is movably mounted within the guide bore. A lock arrangement functions to permit the slide tube to be positioned relative to the support segment at any one of a plurality of height positions. The lock arrangement includes a cartridge assembly that has a gear which is rotatably supported and carried by the slide tube. The gear has a plurality of gear teeth which engage with a series of vertically spaced notches (i.e. a gear rack) defined within the support segment. A lock releasing mechanism functions to displace a lock member between a locking position and a releasing position. The lock releasing mechanism includes an actuator lever and an actuator rod. The actuator lever is supported on the arm element and the actuator rod extends into the support element and mounts the lock member thereon. The lock member has a plurality of locking teeth which engage the gear when the lock member is positioned in the locking position.

Other objects and purposes of the invention will be apparent to persons familiar with structures of this general type upon reading the following specification and inspecting the accompanying drawings.

Figure 1:
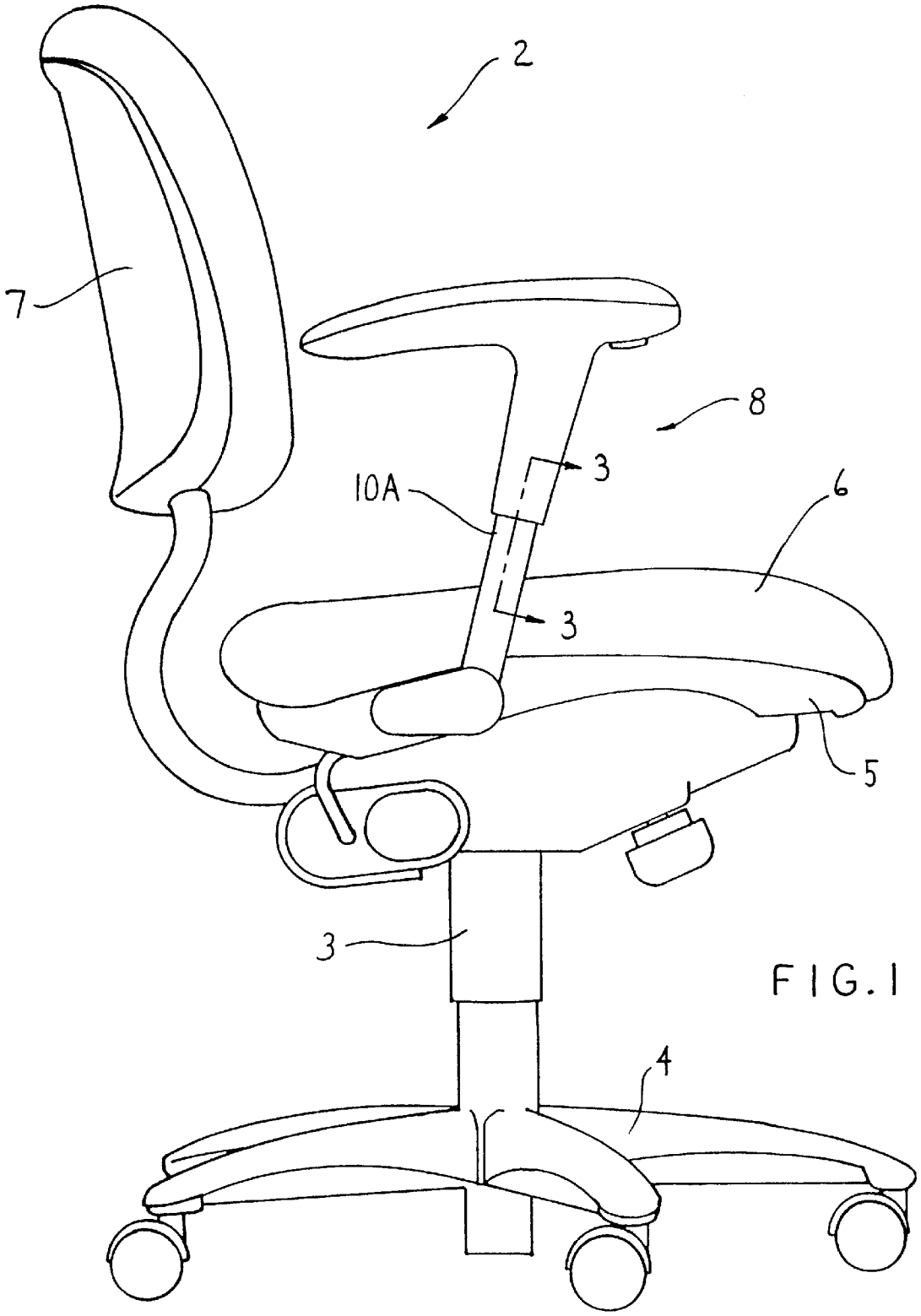
FIG. 1 is a side elevational view of a chair having the improved height-adjustable chair arm assembly of this invention mounted thereon, this view showing the right-side chair arm assembly.
Figure 2:
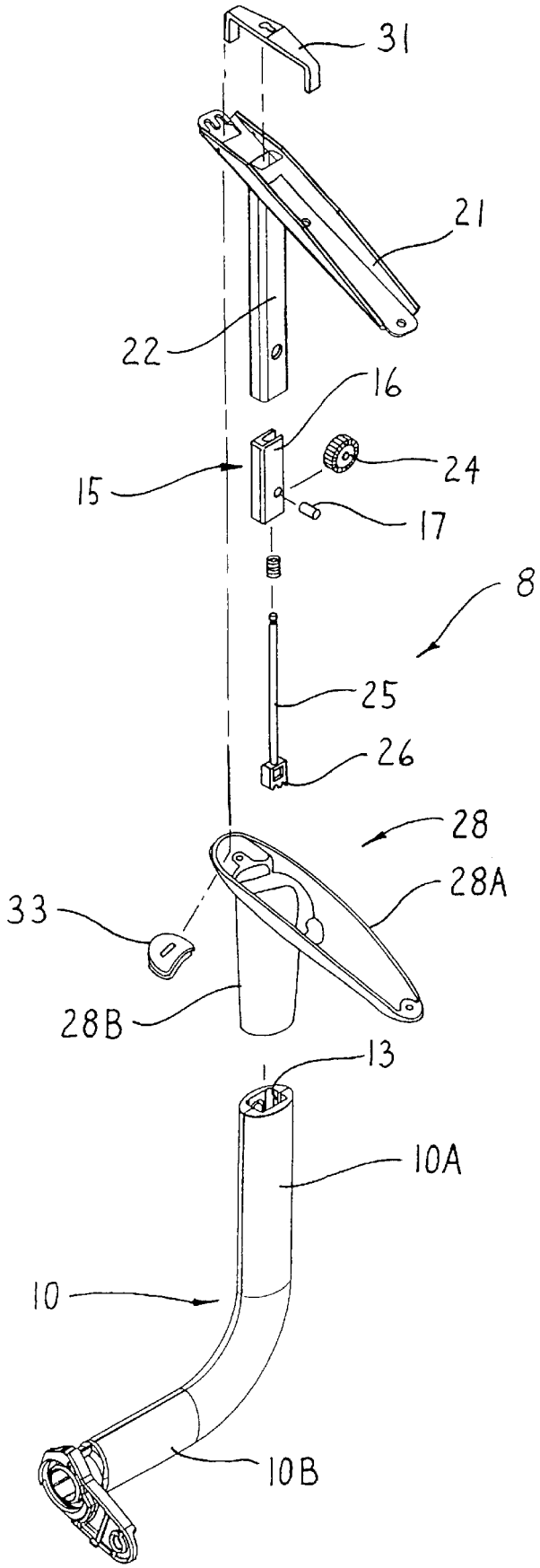
FIG. 2 is an exploded perspective view of the right-side height-adjustable chair arm assembly according to the present invention, the chair arm assembly being shown removed from the chair for clarity of description, and an upper portion of the armrest being shown removed from the chair arm assembly for clarity of description.

Certain terminology will be used in the following description for convenience in reference only, and will not be limiting. For example, the words "upwardly", "downwardly", "rightwardly" and "leftwardly" will refer to directions in the drawings to which reference is made. It will be understood that the words "upwardly" and "downwardly" will also refer to the directions of height adjustment of the armrest relative to the chair seat, these being the actual physical directions experienced by the chair occupant during height adjustment. The words "inwardly" and "outwardly" will respectively refer to directions toward and away from the center of the chair, the center of the arm assembly, or designated parts thereof. Said terminology will include the words specifically mentioned, derivatives thereof, and words of similar import.

DETAILED DESCRIPTION

FIG. 1 diagrammatically illustrates a chair 2, often referred to as an office-type chair. This chair employs a center pedestal 3 which projects upwardly from a wheeled base 4. A suitable seat assembly is mounted on an upper end of the center pedestal 3. The seat assembly includes a chair seat 6 and a chair control or seat frame 5. The chair control 5 supports the chair seat 6 and is mounted thereto. A chair back 7 projects upwardly from a location above the rear edge of the chair seat 6.

The chair 2 is provided with a pair of height-adjustable arm assemblies 8 mounted thereon, namely right and left assemblies which are respectively disposed adjacent the right and left sides of the seat 6 so as to project upwardly therefrom to hence permit the chair occupant to be seated therebetween. The right and left chair arm assemblies 8 are substantially identical except for being mirror images of one another, and only the right side assembly is visible in FIG. 1.

Figure 3:
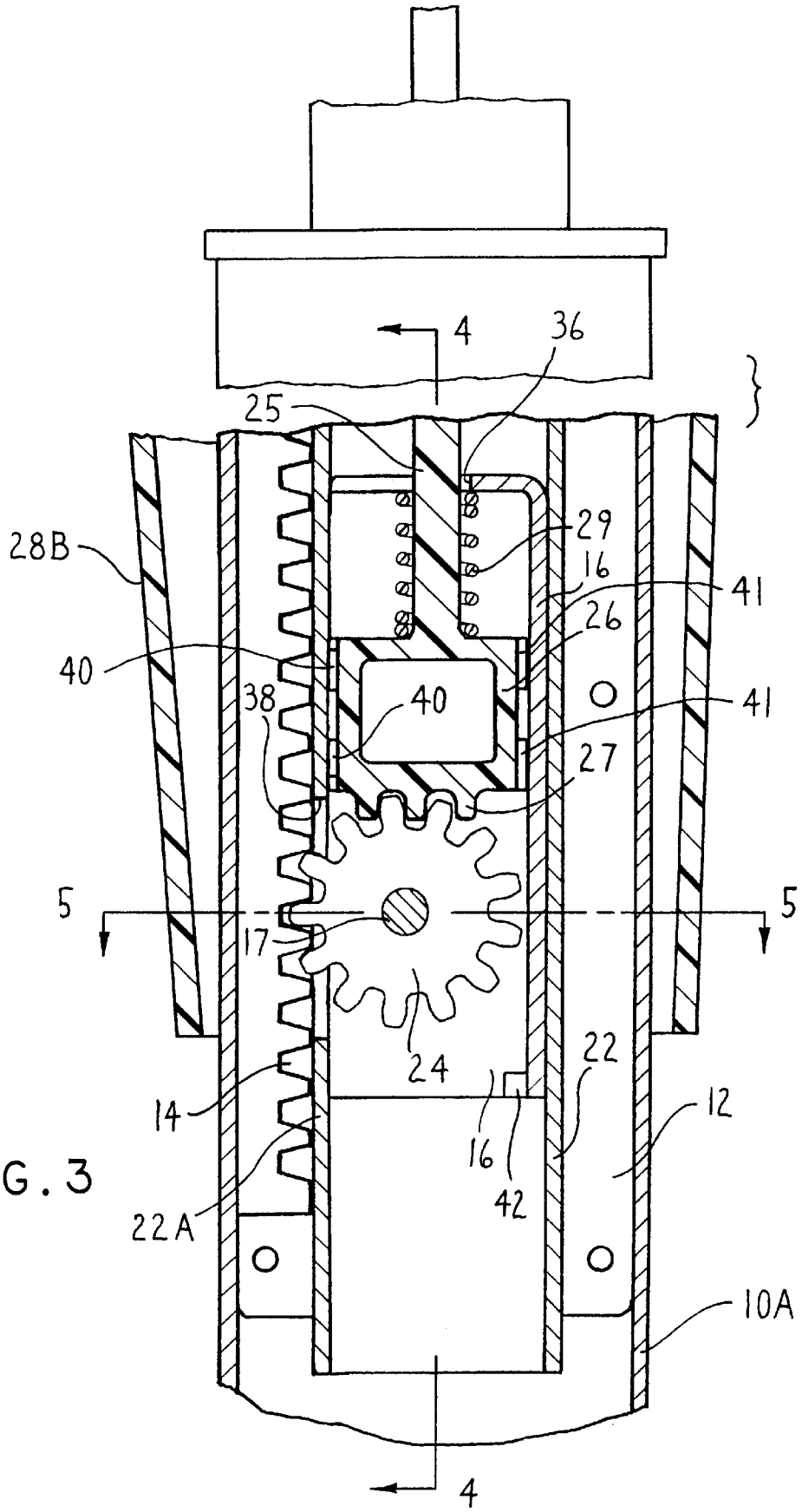
FIG. 3 is an enlarged, fragmentary sectional view taken generally along line 3—3 of FIG. 1.
Figure 4:
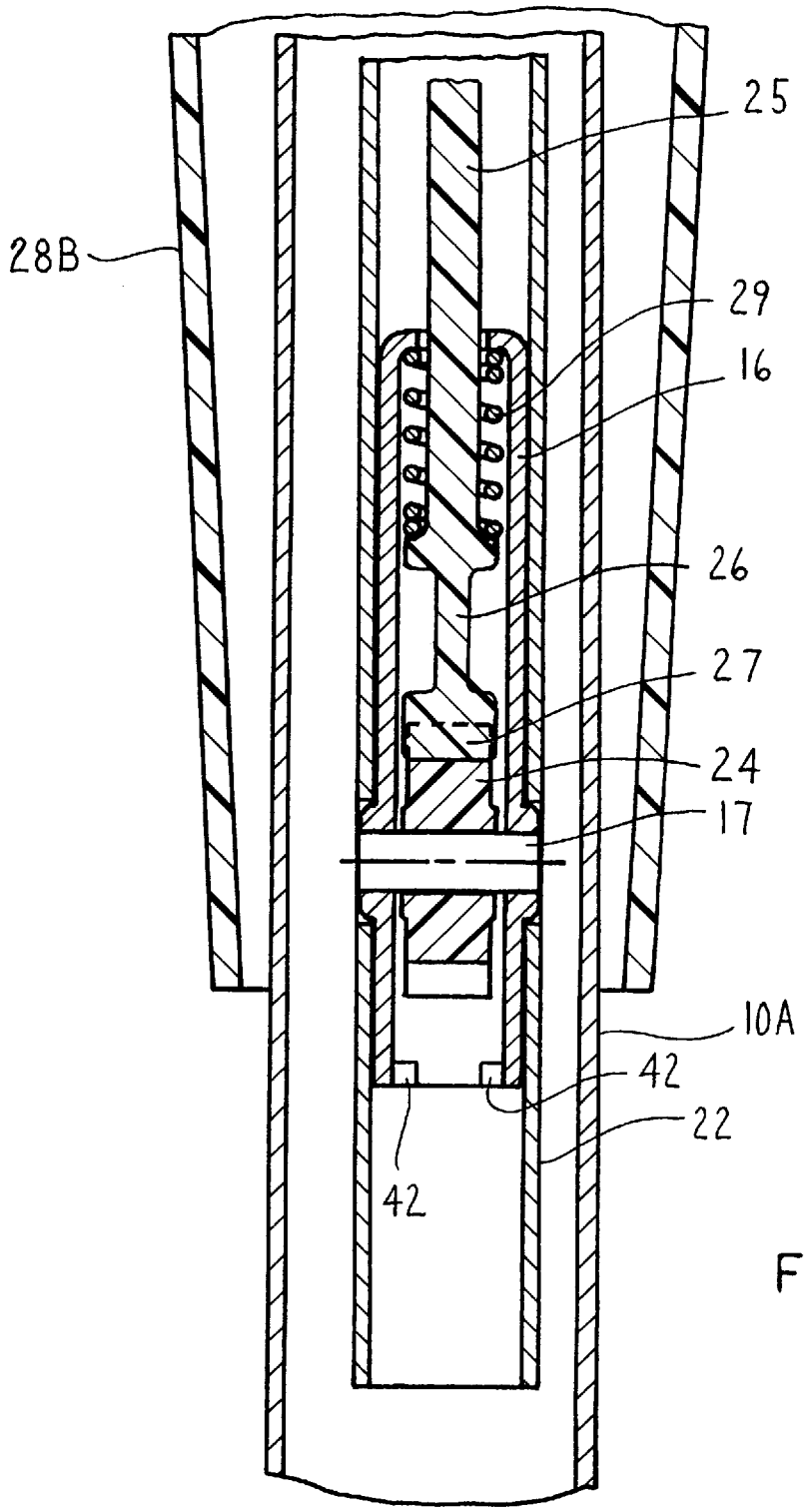
FIG. 4 is a sectional view taken generally along line 4—4 in FIG. 3.
Figure 5:
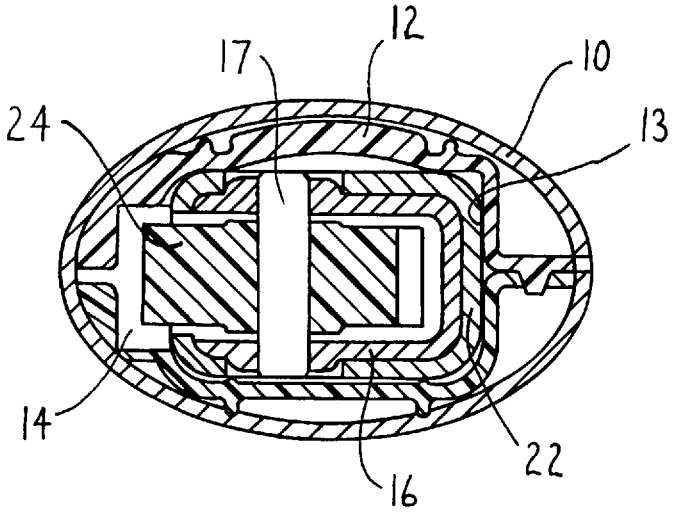
FIG. 5 is a sectional view taken generally along line 5—5 in FIG. 3.
Figure 6:
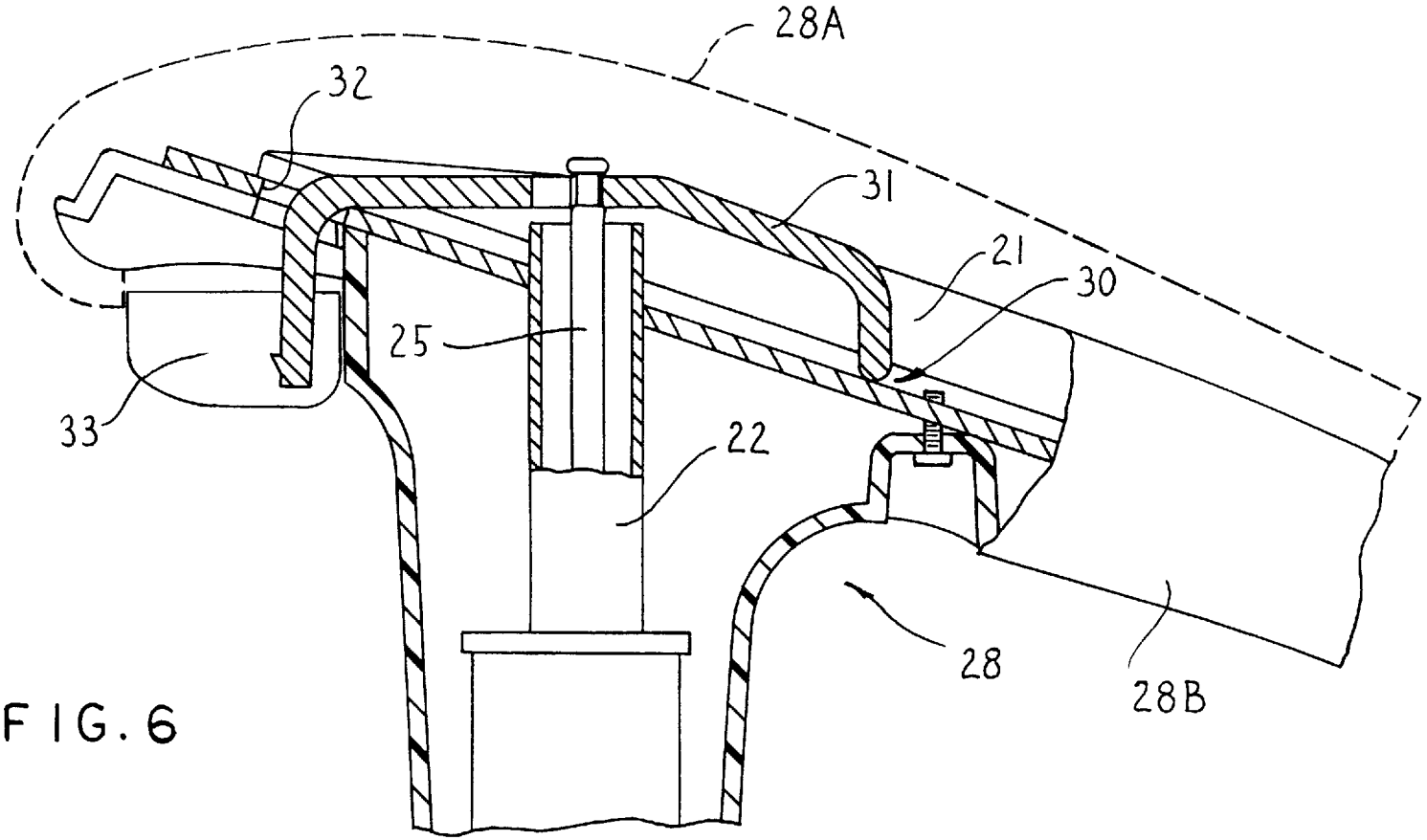
FIG. 6 is a fragmentary sectional view of the armrest of the chair arm assembly of FIG. 1 which shows the cooperation between the actuator rod and the actuator lever.

Referring now to FIGS. 2–7, the right side height-adjustable arm assembly 8 includes an arm upright 10 which is fixed to and projects upwardly from adjacent the seat 6. The arm upright 10 in the illustrated embodiment is generally L-shaped and includes a base leg 10B which is fixed to the seat frame 5, and also includes a vertically elongate and upwardly cantilevered leg or support segment 10A. The support segment 10A has an elongate plastic sleeve 12 fixed vertically therein. The sleeve 12 is constructed of two parts which effectively snap together. The sleeve 12 defines a guide bore 13 which extends through the sleeve. The sleeve 12 further defines interiorly thereof a gear rack 14 which has a plurality of uniformly vertically spaced notches as shown in FIG. 3.

The arm assembly 8 further includes an armrest 28 having an upper portion or arm cap 28A for supporting an occupant's arm thereon and a lower cover portion 28B extending downwardly from the upper portion. The armrest 28 also includes an arm element 21 having a slide tube 22 fixed thereto and projecting downwardly therefrom. The tube 22, in the illustrated embodiment, is of rectangular cross-section and is slidably supported within the guide bore 13 of the sleeve 12.

The arm assembly 8 additionally includes a compact cartridge assembly 15 which is secured interiorly of the tube 22. The cartridge assembly 15 includes a generally channel-shaped housing 16 which is fixed within the tube 22. The tube 22 has a window or aperture 38 defined in a vertical side wall 22A thereof as shown in FIG. 3, which window 38 communicates with the interior of the housing 16 through an open side thereof. A gear 24 is rotatably supported within the housing 16 by a pin 17 which extends transversely between and is supported on opposite side walls of the housing 16. The gear 24 is supported in the housing 16 such that a plurality of teeth on one side of the gear 24 project through the open side of the housing and extend through the aperture 38 so as to engage the plurality of vertically spaced notches of the gear rack 14 as shown in FIG. 3.

Figure 7:
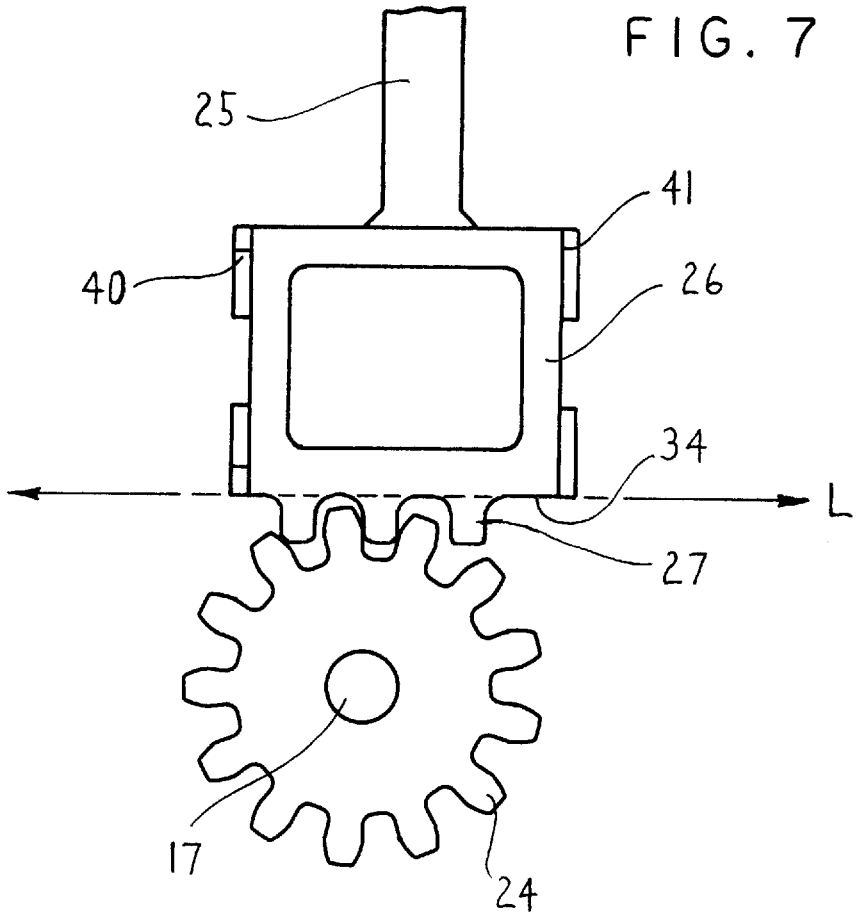
FIG. 7 is a fragmentary view of only the locking member and gear of FIG. 3, the rest of the chair arm assembly parts being removed for clarity of illustration.

The housing 16 further has an opening 36 defined within a top wall thereof. An elongate actuator rod 25 projects downwardly through the tube 22 and the housing opening 36 and has a lock member 26 secured to the lower end thereof. The lock member 26 includes a plurality of downwardly projecting locking teeth 27 which engage the upper toothed portion of the gear 24. The locking teeth 27 are configured to be generally rectangularly shaped as shown in FIGS. 3 and 7. Moreover, the locking teeth 27 protrude downwardly from a substantially planar bottom portion or surface 34 of the lock member 26. FIG. 7 depicts a side elevational view of the lock member 26 which shows the planar bottom portion of the lock member defining a line L from which the locking teeth 27 protrude. Since the locking teeth 27 are configured to be generally rectangularly shaped and have generally parallel side surfaces which protrude substantially perpendicularly from a substantially planar wall portion of the lock member 26, the locking teeth 27 and the gear 24 cooperate so as to provide for a more positive locking relationship therebetween which reduces the likelihood of accidental disengagement between the locking teeth 27 and the gear 24.

The lock member 26 is vertically slidably confined within the cartridge housing 16 by being slidably engaged and positioned between the bight or base wall of the channel-shaped housing 16 and the wall 22A of the tube 22 as shown in FIG. 3. A spring 29 coacts between the top wall of housing 16 and the locking member 26 for movably biasing the locking teeth 27 downwardly in perpendicular relation relative to the rotational axis of the gear 24 into a position of meshed engagement with gear 24 as illustrated in FIG. 3. The lock member 26 is thus confined for movement in a direction which is substantially perpendicular to the rotational axis of the gear 24. Also, the engaged or meshed relation between the locking teeth 27 and the teeth of gear 24 also occurs on or is substantially centered along a radial line which intersects the gear axis and which is substantially parallel with the movement direction of the lock member 26.

To provide a close fit of the lock member 26 in the cartridge housing 16, vertically spaced pairs of fins or ribs 40 and 41 are formed on opposite sides of the lock member 26. To ensure the correct orientation of the lock member 26, a horizontally spaced pair of projections 42 are formed on the cartridge housing 16. The fins 41 are formed vertically elongate so to be slidable between the projections 42. The fins 40, however, are T-shaped such that the horizontal legs thereof interfere with the projections 42 to insure the proper orientation of the lock member 26 as seen in FIG. 3.

The actuator rod 25 has its upper end coupled to an actuator lever 31. A first end of the actuator lever 31 is urged downwardly against the arm element 21 at a pivot point 30. A second end of the actuator lever 31 extends through an opening 32 defined in the arm element 21. Secured to the second end of the actuator lever 31 is a finger-engaging pad or button 33. The pad 33 is located adjacent to but under a forward end of the armrest 28 for easy engagement by an occupant's fingers.

In operation, when the occupant presses the pad 33 upwardly, the actuator rod 25 is pulled upwardly against the bias of spring 29 so as to disengage the locking teeth 27 from the gear 24, thus allowing gear 24 to roll along rack 14 to permit height adjustment of the armrest 28. When the occupant desires to lock the armrest 28 at a certain height position, the pad 33 is released and spring 29 urges the locking teeth 27 downwardly so as to automatically reengage the gear 24 when the gear teeth reach a position where they engage the slots defined between the locking teeth 27.

Although a particular preferred embodiment of the invention has been disclosed in detail for illustrative purposes, it will be recognized that variation or modifications of the disclosed apparatus, including the rearrangement of parts, lie within the scope of the present invention.

The embodiments of the invention in which an exclusive property or privilege is claimed are defined as follows:

1. In a chair having a seat assembly, a back projecting upwardly from a location adjacent a rear edge of the seat assembly, and a pair of height-adjustable arm assemblies mounted on and disposed adjacent opposite sides of said seat assembly and projecting upwardly in cantilevered relation therefrom, the improvement wherein each arm assembly comprises:

an arm upright fixed to said seat assembly and including a vertically elongate support segment disposed on one side of said seat assembly, said support segment having a hollow interior and including a tubular liner supported therein, said tubular liner having an interior bore surface defining therein a vertically elongate guide bore which is open at an upper end thereof, said interior bore surface including a series of vertically-spaced notches;

an armrest having a vertically elongate slide tube lengthwise movably supported within said guide bore and projecting upwardly therefrom and terminating at an upper end part which is disposed at an elevation spaced upwardly above said seat assembly, said armrest further having a horizontally elongate arm element mounted on the upper end part of said slide tube and projecting horizontally therefrom;

a releasable lock arrangement coacting between said support segment and said slide tube for permitting said slide tube to be stationarily, fixedly positioned relative to said support segment at any one of a plurality of selectable height positions, said lock arrangement including a gear which is rotatably supported and carried in said slide tube, said gear having a plurality of gear teeth which engage with said series of vertically spaced notches; and a lock releasing mechanism extending from said armrest into said support segment and including a lock member vertically movable in said slide tube toward and away from said gear between a locking position and a releasing position, said lock releasing mechanism further including an actuator arm extending lengthwise of and movably supported on said arm element and terminating in a manually-engagable button part disposed at an underside of said arm element adjacent an end portion thereof, said arm rest having an upper surface facing away from said button part and said button part being engagable by manual pressing of said upper surface and said button part together for manually adjusting the height of said arm assemblies, and a vertically elongate actuator rod extending interiorly and lengthwise of said support segment and having an upper end engaged with said actuator arm and a lower end fixedly coupled to the lock member, said actuator rod being moved vertically in response to manual engagement of said button part, said lock member having a locking tooth which engages said gear when the lock member is positioned in the locking position to prevent vertical movement of said arm rest.

2. A chair according to claim 1, wherein said lock member has a substantially planar bottom surface having a plurality of locking teeth extending downwardly therefrom.

3. A chair according to claim 2, wherein said locking teeth are substantially rectangularly shaped.

4. A chair according to claim 1, wherein said lock arrangement includes a housing in which said gear is rotatably supported, said housing being fixedly positioned within said slide tube.

5. A chair according to claim 4, wherein said lock arrangement includes a pin retained within said housing, said gear being supported by said pin for rotation about the axis thereof.

6. A chair according to claim 4, wherein said lock member is fixed to a lower end of said actuator rod and is vertically slidably supported in said housing at a position directly above said gear.

7. A chair according to claim 1, wherein said actuator arm includes a first end which is biased against said arm element at a pivot point, and a second end which extends through an opening defined within said arm element.

8. A chair according to claim 7, wherein said upper end of said actuator rod is attached to said actuator arm at a location between said first and second ends of said actuator arm.

9. A height-adjustable arm assembly for a chair, comprising:

an arm upright including a vertically elongate support segment, said support segment defining therein a vertically elongate guide bore which is open at an upper end thereof;

an armrest having an elongate slide tube lengthwise movably supported within said guide bore and projecting upwardly therefrom and terminating at an upper end part, said armrest further having a horizontally elongate arm element mounted on the upper end part of said slide tube and projecting horizontally therefrom;

a releasable lock arrangement coacting between said support segment and said slide tube for permitting said slide tube to be stationarily, fixedly positioned relative to said support segment at any one of a plurality of selectable height positions, said lock arrangement including a housing carried by said slide tube and a gear which is rotatably supported within said housing for rotation about an axis which extends transversely relative to the lengthwise extent of said slide tube, said slide tube and said housing have side openings defined in vertical side walls thereof and said housing having a top opening defined within a top wall thereof, said gear having a plurality of gear teeth which extend through said side openings and engage with a series of vertically spaced notches which are defined within said support segment, and a movable lock member positioned adjacent said gear and within said slide tube, said lock member being vertically slidably supported within said housing, said lock member having a plurality of locking teeth which engage said gear when the lock member is positioned in the locking position; and a lock releasing mechanism extending from said armrest into said support segment for displacing the lock member between a locking position and a releasing position, said lock releasing mechanism including an actuator arm extending lengthwise of and movably supported on said arm element and terminating in a manually-engagable button part disposed at an underside of said arm element adjacent an end portion thereof, and an actuator rod extending interiorly and lengthwise of said support segment and having an upper end connected to said actuator arm and a lower end coupled to the lock member, said actuator rod extending through said top opening of said top wall, and said lock arrangement further including a spring which is positioned around said actuator rod at a location between said lock member and said top wall.

10. A chair according to claim 9, wherein said lock member has a substantially planar bottom surface, and said plurality of locking teeth are substantially rectangularly shaped and extend downwardly from said planar bottom surface.

11. A chair according to claim 9, wherein said lock arrangement includes said housing and a pin, and said gear is rotatably supported by said pin within said housing for rotation about said axis.

12. A chair according to claim 9, wherein said actuator arm includes a first end which is biased against said arm element at a pivot point, and a second end which extends through an opening defined within said arm element, and said upper end of said actuator rod is attached to said actuator arm at a location between said first end and said second end of said actuator lever.

an arm upright including an elongate support segment, said support segment defining therein an elongate guide bore which is open at an upper end thereof;

an armrest having an elongate slide tube and an arm element, said slide tube having a first end which is supported within said guide bore and a second end which is attached to said arm element;

a releasable lock arrangement for permitting said slide tube to be stationarily positioned relative to said support segment at any one of a plurality of height positions, said lock arrangement including a gear which is rotatably supported and carried by said slide tube, said gear having a plurality of gear teeth which engage with a series of vertically spaced notches which are defined within said support segment, and a movable lock member positioned adjacent said gear; and a lock releasing mechanism for displacing said lock member between a locking position and a releasing position, said lock releasing mechanism including an actuator part supported adjacent said arm element and connected to an actuator rod extending into said support segment, said lock member being coupled to a lower end of said actuator rod and having one or more locking teeth which engage said gear when the lock member is positioned in the locking position.

13. A height-adjustable arm assembly for a chair, comprising:

an arm upright including an elongate support segment, said support segment having an elongate hollow interior and a tubular liner supported therein, said tubular liner having an interior bore surface defining therein an elongate guide bore which is open at an upper end thereof, said interior bore surface extending vertically along the length of said guide bore and including a series of vertically spaced notches along the length thereof;

an armrest having an elongate slide tube and an arm element, said slide tube having a first end which is supported within said guide bore and a second end which is attached to said arm element, said slide tube defining a hollow interior and including an exterior tube surface which is vertically elongate and is slidably supported about the periphery thereof by said interior bore surface of said guide bore to substantially prevent horizontal movement of said slide tube in said guide bore, said slide tube including an opening in said exterior tube surface;

a releasable lock arrangement for permitting said slide tube to be stationarily positioned relative to said support segment at any one of a plurality of height positions, said lock arrangement including a gear which is rotatably supported in said hollow interior and carried by said slide tube, said gear having a plurality of gear teeth which project sidewardly through said opening in said slide tube and engage with said vertically spaced notches which are defined within said support segment, and a movable lock member positioned adjacent said gear and within said hollow interior; and a lock releasing mechanism for displacing said lock member between a locking position and a releasing position, said lock releasing mechanism including an actuator part supported adjacent said arm element and connected to an actuator rod extending into said support segment, said lock member being coupled to a lower end of said actuator rod and having one or more locking teeth which engage said gear when the lock member is positioned in the locking position so that said gear prevents vertical movement of said slide tube.

14. A chair according to claim 13, wherein said lock member has a substantially planar bottom surface, and each of said plurality of locking teeth are substantially rectangularly shaped and extend downwardly from said planar bottom surface.

15. A chair according to claim 13, wherein said exterior tube surface is slidably supported by said interior bore surface vertically above and below said gear.

16. In a chair having a seat assembly, a back projecting upwardly from a location adjacent a rear edge of the seat assembly, and a pair of height-adjustable arm assemblies mounted on and disposed adjacent opposite sides of said seat assembly and projecting upwardly in cantilevered relation therefrom, the improvement wherein-each arm assembly comprises:

an arm upright fixed to said seat assembly and including a vertically elongate support segment disposed on one side of said seat assembly, said support segment defining therein a vertically elongate guide bore which is open at an upper end thereof;

an armrest having a vertically elongate slide tube lengthwise movably supported within said guide bore and projecting upwardly therefrom and terminating at an upper end part which is disposed at an elevation spaced upwardly above said seat assembly, said armrest further having a horizontally elongate arm element mounted on the upper end part of said slide tube and projecting horizontally therefrom;

a releasable lock arrangement coacting between said support segment and said slide tube for permitting said slide tube to be stationarily, fixedly positioned relative to said support segment at any one of a plurality of selectable height positions, said lock arrangement including a housing fixedly positioned within said slide tube and a gear which is rotatably supported and carried by said housing in said slide tube, said housing and said slide tube having side openings defined in vertical side walls thereof and said housing having a top opening defined within a top wall thereof, said gear having a plurality of gear teeth which extend through said side openings and engage with a series of vertically spaced notches which are defined within said support segment; and a lock releasing mechanism extending from said armrest into said support segment and including a lock member movable between a locking position and a releasing position, said lock releasing mechanism further including an actuator arm extending lengthwise of and movably supported on said arm element and terminating in a manually-engagable button part disposed at an underside of said arm element adjacent an end portion thereof, and an actuator rod extending interiorly and lengthwise of said support segment and having an upper end contacting said actuator arm and a lower end coupled to the lock member, said actuator rod extending through said top opening of said housing, said actuator rod being moved lengthwise in response to manual engagement of said button part, said lock member having a locking tooth which engages said gear when the lock member is positioned in the locking position.

17. A chair according to claim 1, wherein said lock arrangement includes a spring which is positioned around said actuator rod at a location between said lock member and said top wall of said housing.

18. A height-adjustable arm assembly for a chair, comprising:

an arm upright including an elongate support segment, said support segment having an interior bore surface defining therein an elongate guide bore which is open at an upper end thereof, said interior bore surface extending vertically along the length of said guide bore and including a series of vertically spaced notches along the length thereof;

an armrest having an elongate slide tube and an arm element, said slide tube having a first end which is supported within said guide bore and a second end which is attached to said arm element, said slide tube defining a hollow interior and including an exterior tube surface which is vertically elongate and is slidably supported about the periphery thereof by said interior bore surface of said guide bore to substantially prevent horizontal movement of said slide tube in said guide bore, said slide tube including an opening in said exterior tube surface;

a releasable lock arrangement for permitting said slide tube to be stationarily positioned relative to said support segment at any one of a plurality of height positions, said lock arrangement including a gear which is rotatable supported in said hollow interior and carried by said slide tube, said gear having a plurality of gear teeth which project sidewardly through said opening in said slide tube and engage with said vertically spaced notches which are defined within said support segment, and a movable lock member positioned adjacent said gear and within said hollow interior, each of said vertically spaced notches extending horizontally away from said slide tube and including an aperture formed in said interior bore surface, each vertically adjacent pair of said notches having a portion of said bore surface extending vertically between said apertures thereof which slidably supports said slide tube; and a lock releasing mechanism for displacing said lock member between a locking position and a releasing position, said lock releasing mechanism including an actuator part supported adjacent said arm element and connected to an actuator rod extending into said support segment, said lock member being coupled to a lower end of said actuator rod and having one or more locking teeth which engage said gear when the lock member is positioned in the locking position so that said gear prevents vertical movement of said slide tube.

* * * * *

UNITED STATES PATENT AND TRADEMARK OFFICE

CERTIFICATE OF CORRECTION

PATENT NO. : 5 829 839

DATED : November 3, 1998

INVENTOR(S) : Larry A. WILKERSON et al

It is certified that error appears in the above-identified patent and that said Letters Patent is hereby corrected as shown below:

Column 7, delete lines 6-30 in their entirety.

Column 8, line 20; change "wherein-each" to
---wherein each---.

Column 9, line 1; change "according to claim 1" to
---according to claim 16---.

Column 10, line 2; change "rotatable" to
---rotatably---.

Signed and Sealed this

Sixth Day of April, 1999

*Attest:*

Q. TODD DICKINSON

*Attesting Officer*

*Acting Commissioner of Patents and Trademarks*